US009843132B2

(12) United States Patent
Ludwig

(10) Patent No.: US 9,843,132 B2
(45) Date of Patent: Dec. 12, 2017

(54) CABLE STRAIN RELIEF

(71) Applicant: DELPHI TECHNOLOGIES, INC., Troy, MI (US)

(72) Inventor: Martin Ludwig, Wuppertal (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/316,596

(22) PCT Filed: Jun. 12, 2015

(86) PCT No.: PCT/EP2015/063227
§ 371 (c)(1),
(2) Date: Dec. 6, 2016

(87) PCT Pub. No.: WO2015/189414
PCT Pub. Date: Dec. 17, 2015

(65) Prior Publication Data

US 2017/0155210 A1 Jun. 1, 2017

(30) Foreign Application Priority Data

Jun. 13, 2014 (EP) ..... 14172422

(51) Int. Cl.
*H01R 13/627* (2006.01)
*H01R 13/58* (2006.01)
*H01R 13/426* (2006.01)

(52) U.S. Cl.
CPC ..... *H01R 13/6275* (2013.01); *H01R 13/426* (2013.01); *H01R 13/5812* (2013.01)

(58) Field of Classification Search
CPC ..... H01R 13/6271; H01R 13/6275
USPC ..... 439/358, 357
See application file for complete search history.

(56) References Cited

U.S. PATENT DOCUMENTS

| | | | | |
|---|---|---|---|---|
| 5,342,215 A | 8/1994 | Silbernagel | | |
| 6,302,721 B1 | 10/2001 | Turner | | |
| 6,579,113 B2 * | 6/2003 | Kodama | H01R 13/6272 | 439/358 |
| 2002/0090856 A1 * | 7/2002 | Weisz-Margulescu | H01R 13/6273 | 439/358 |

FOREIGN PATENT DOCUMENTS

| | | |
|---|---|---|
| EP | 2105996 A1 | 9/2009 |
| GB | 2308755 A | 7/1997 |
| WO | 2012123460 A1 | 9/2012 |

* cited by examiner

*Primary Examiner* — Phuong Dinh
(74) *Attorney, Agent, or Firm* — Robert J. Myers

(57) ABSTRACT

The present invention relates to an electrical connector system comprising a contact terminal, a connector housing defining an aperture that receives the contact terminal therein, and a cable strain relief member separate from the connector housing. The cable strain relief member comprises a fastening feature for fastening the strain relief member to a cable for strain relief, and an integrated locking feature for locking the strain relief member to a corresponding counter connector.

22 Claims, 3 Drawing Sheets

CABLE STRAIN RELIEF

CROSS-REFERENCE TO RELATED APPLICATION

This application claims the benefit under 35 U.S.C. §371 of published PCT Patent Application Number PCT/EP 2015/063227, filed 12 Jun. 2015, claiming priority to European patent application number EP14172422.9 filed on 13 Jun. 2014, the entire contents of which is hereby incorporated by reference herein.

TECHNICAL FIELD OF INVENTION

The invention relates to an electrical connector system with a cable strain relief member.

BACKGROUND OF INVENTION

It is known that electrical connector systems are used to connect various cables, such as telecommunication cables, networking cables, other signaling cables or in general any electrical wiring, for example. Electrical connector systems are used for joining electrical circuits, wherein typically a male-ended plug is designed to connect to a female-ended jack. In many applications the safe coupling of connectors is of high importance. For example, in the case of car safety systems, e.g. airbag systems in passenger cars, the connectors used for the connection of an airbag to its ignition base have to be provided with reliable safety systems. To ensure that the connectors cannot become loose unintentionally, secondary locking systems may be used to guarantee the safe mechanical coupling. Often, such secondary locking systems are realized in the form of separate plastic components, which may be installed on one of the connectors which are to be secured, or are directly molded on the connector.

Additionally, in many fields of applications, electrical connector systems require cable strain relief members which firmly attach the cables to the connector systems in order to relieve the actual connection portion of the cable from possible strains. This connection portion, where the cable is dismantled and the cable wiring may be connected to a contact terminal, can be particularly fragile and therefore has to be protected. Cable strain relief members are known in the art to relieve electrical connector systems from strains applied to a cable. Normally, any forces applied to a cable directly act on the crimp area, i.e. the interconnection where the cable is connected to a contact terminal. These terminals of electrical connectors are usually very small components, such as components that are stamped and/or formed from thin sheet metal material and easily damaged or destroyed by the strain.

An improper seating of a contact terminal in a connector housing may occur if the terminal is not fully inserted therein during the initial assembly of the electrical connector system or if the contact terminal is vibrated or pulled out of its fully seated condition during use of the connector system. Failures of this type are a particular concern in the automotive industry where electrical components are subjected to vibration almost continuously during normal usage. It is therefore known in the art to provide a terminal position assurance (TPA) device for electrical connectors to detect incomplete insertion of contact terminals into the connector housings. TPAs also assure that the contact terminal is properly positioned in the respective housing.

SUMMARY OF THE INVENTION

Described herein is an electrical connector system that reduces the strain on the crimping area and also on the primary and/or secondary lock of connector systems. It is in particular an object of the present invention to provide an electrical connector system which comprises a minimal number of components and is simple to be mounted. It is a further object to provide an electrical connector system which features terminal position assurance (TPA).

In accordance with one embodiment, an electrical connector system is provided. The connector system comprises a contact terminal, and a corresponding connector housing. The contact terminal thereby may comprise an insulation crimp and a wire crimp to connect to a cable, and may provide an electrical interface for a corresponding counter connector. The connector housing defines an aperture which is designed to receive the contact terminal therein. The housing itself may in generally have any shape designed to connect to the corresponding counter connector. The connector housing may include a feature for locking the housing to the corresponding counter connector. The electrical connector system further comprises a cable strain relief member separate from the connector housing. Accordingly, the cable strain relief member is not an integral part of the connector housing. The cable strain relief member comprises cable fastening feature for fastening the cable strain relief member to a cable for strain relief. Furthermore, the cable strain relief member comprises an integrated locking feature that locks the member directly to a corresponding counter connector.

The term "counter connector" used herein denotes to any kind of connector designed to connect to the connector housing and contact terminal provided therein. The counter connector may have a suitable feature for fixing it to its environment, such as to a wall of an electrical component, and may provide a respective electrical feed-through there through. The counter connector may further be of any suitable shape, depending on the actual application and design of the connector housing. The counter connector, the connector housing, and the cable strain relief member are preferably fabricated by injection molding.

The cable strain relief member is a single, separate, member and is designed to transfer any cable strain directly to the corresponding counter connector. In other words, any pull-out forces applied to the cable are transferred via the cable strain relief member to the counter connector, and not to the connector housing. Accordingly, the crimp area of the terminal arranged in the connector housing has to withstand less force due to the fact that the cable strain relief member transfers the force to the counter connector. Advantageously, the present system also relieves any primary locking feature of the connector housing to the counter connector, and it is applicable in connector systems where the connector housing cannot be provided with an integrated primary lock, due to space limitations, for example.

Similarly, the primary and/or secondary lock connecting the contact terminal to the connector housing has to withstand less pull-out force because the cable strain relief member transfers the pull-out force to the corresponding counter connector. Thereby, the pull-out force is advantageously not completely acting on the crimp area and the primary and/or secondary lock of the contact terminal. Thereby the life time of the electrical connector system is prolonged.

The term "pull-out force" used herein denotes to any force that is acted so as to pull out a wire or cable from an electrical connector system. Analogously, the term "push-in force" used herein denotes to any force that is acted so as to push in a wire or cable into an electrical connector system.

In another embodiment, the cable strain relief member further comprises a mounting feature for mounting the member to the connector housing. This mounting feature is preferably a hook that envelopes a section of the connector housing when the cable strain relief member is mounted thereto. In one embodiment, this hook has preferably a U-shaped cross-sectional profile.

This mounting feature allows for a simple assembly process and advantageously fixes the cable strain member to the connector housing, thereby improving stability of the electrical connector system.

The terms "fastening", "locking", "mounting" and such used herein in connection with different features do not imply a particular application or method, but are merely used to label the different features for clarification. Accordingly, mounting feature may generally provide locking functions, for example, and locking feature may be used for mounting.

Preferably, the mounting features are designed to provide terminal position assurance (TPA) when the contact terminal is provided in the at least one aperture of the connector housing and the cable strain relief member is mounted to the connector housing. TPA is known in the art to assure correct positioning of the contact terminal inside the connector housing, thereby reducing the need for time-consuming and costly inspection during assembly.

Preferably, the mounting feature for mounting the cable strain relief member to the connector housing provide a lock for the contact terminal to secure the contact terminal in its position in the aperture of the connector housing. The mounting feature may thereby function as a primary lock or as a secondary lock for the contact terminal. Preferably, the mounting feature includes a portion which extends into the connector housing when the cable strain relief member is mounted thereto. This portion is thereby designed to prevent removal of the contact terminal from the aperture of the connector housing. In other words, the portion locks the aperture of the connector housing such that the contact terminal cannot be removed therefrom.

In yet another embodiment, the cable strain relief member is designed to releasable lock the connector housing to the corresponding counter connector. In other words, the cable strain relief member enables locking and removing the connector housing to and from the counter connector. Preferably, the cable strain relief member comprises an integrated flexible web which is supporting the integrated locking feature designed for locking the strain relief member directly to the corresponding counter connector. A flexible web may be of any form designed to provide a restoring force when an external force is applied thereto. Accordingly, the integrated locking feature may be provided on the flexible web such that the integrated locking feature is shifted or repositioned when a force is applied to the web. Thereby, the flexible web is designed to release the integrated locking feature from the corresponding connector when an external force is applied to the flexible web. Preferably, the integrated flexible web includes an actuating member. Accordingly, the connector housing with the cable strain relief member can easily be inserted and removed to the corresponding counter connector by applying force to the flexible web thereby interacting with the integrated locking feature such that the insertion or removal is not locked or blocked.

The actuating member may preferably be actuated by an operator for unlocking the strain relief member from the counter connector. Preferably the actuating member may be actuated by a suitable tool, such as a screw driver, for example. The actuating member is preferably formed such that it may readily be actuated with such a tool, without damaging the actuating member or the strain relief member. Preferably the strain relief member is designed such that its locking function may only be released when applying large external forces thereto. Thus, a resilient connection between the connector housing and the counter connector may be achieved, which cannot be released accidentally.

Preferably the actuating member of the strain relief member is located outside the counter connector when the strain relief member is locked thereto. Accordingly, the actuating member is not encased by the counter connector such that it may be accessible by an operator for releasing the locking function as described and for removing the connector housing from the counter connector. Hence the releasing of the connector housing from the counter connector may be done in a straightforward manner.

Preferably, the integrated locking feature is a locking ramp, which is designed to engage a corresponding locking window in a mating part of the corresponding counter connector. In another preferred embodiment, the integrated locking feature of the cable strain relief member is a locking window and the mating part of the corresponding counter connector is preferably a locking ramp. The locking ramp is in both cases designed to lower the flexible web of cable strain relief member when the connector housing with mounted cable strain relief member is inserted into the corresponding counter connector during assembly of the electrical connector system. Once inserted, the locking ramp face, which defines a force normal to the direction of insertion, provides the locking function. Accordingly, the interplay of a locking ramp and a corresponding locking window allows for an easy assembly of the electrical connector system.

Also the integrated locking feature may preferably be actuated by an operator for unlocking the strain relief member from the counter connector, for example by use of a suitable tool, such as a screw driver, for example. Preferably the strain relief member is designed to be unlocked from the counter connector when an external force is applied to the integrated locking feature of the strain relief member. Preferably, the external force is thereby applied in a mating direction of the connector system, i.e. the direction of insertion or removal of the connector housing to or from the counter connector. Preferably, the integrated locking feature may be accessed from outside the counter connector through a respective opening provided therein, wherein such an opening is preferably provided in the mating direction of the connector system. Thereby the locking function can be released from the opposite side of insertion or removal, i.e. from "inside" the connector housing, as the integrated locking feature is reachable from inside the counter connector, even though the connector housing is arranged in the counter connector.

In yet another embodiment of the present invention, the contact terminal comprises primary locking feature, which is designed to lock the contact terminal in the aperture of the connector housing. Preferably, the primary locking feature is a latching lance which enables easy insertion of the contact terminal into the connector housing and lock the contact terminal therein. Preferably, the connector housing may also comprise a locking feature, which is designed to provide a primary lock for the connector housing to the corresponding counter connector.

In yet another embodiment, the cable strain relief member comprises a spacer which separates the cable from the connector housing when the system is fully mounted, i.e. when the cable is connected to the contact terminal, which in turn is inserted into the aperture of the connector housing, and the cable strain relief member is fastened to the cable. The spacer, provided between the cable and the connector housing, advantageously protects the crimping area when, for example, the cable is forced or pushed further into the connector housing. The spacer preferably comprises two surfaces, wherein a first surface is in contact with the connector housing while a second surface is in contact with a cable sheeting of the cable. Hence, when the cable is pushed, the force is preferably transferred via the spacer to the connector housing, thereby advantageously reducing strain on the crimp area.

The system may preferably further comprise a corresponding counter connector which may be any connector that is compatible with the connector housing a contact terminal positioned therein, and a cable strain relief member mounted to the connector housing. Preferably, the corresponding counter connector is designed to interact with the integrated locking feature of the cable strain relief member to provide cable strain relief. Preferably, the counter connector comprises an opening enabling to apply an external force in mating direction of the connector system to the strain relief member, and in particular to the integrated locking feature of the strain relief member, for unlocking the strain relief member from the counter connector. The opening may be provided on the counter connector in mating direction of the connector system and is preferably separate from the aperture of the counter connector and may be provided on an opposing side of the counter connector with respect to said aperture. Accordingly, the locking function can easily be released by inserting a screw driver through the opening and by applying a respective force to the strain relief member with the screw driver. Preferably the connector housing and/or the counter connector include a respective groove or path allowing for guiding a respective tool for applying said force in mating direction to the strain relief member for unlocking the locking function.

Preferably the connector housing comprises a rib designed to interact with the counter connector for preventing a further insertion of the connector housing into the counter connector when the strain relief member is locked to the counter connector. Preferably the aperture of the counter connector is step-like shaped, wherein a first step of the step-like shaped aperture is designed to interact with such a rib of the connector housing for preventing a further insertion as described. Accordingly, when the connector housing is inserted into the aperture of the counter connector far enough, such that the integrated locking feature of the strain relief member are locking the member to the counter connector, the rib comes into blocking contact with the first step of the step-like shaped aperture such that further insertion forces, or push-in forces are transferred via said blocking contact to the counter connector. Hence the contact terminal is protected.

Further, the system may preferably comprise a cable mounted to the contact terminal, wherein the mounting may comprise any means known to one skilled in the art to attach the cable to the contact terminal. For example, an insulation crimp to connect the contact terminal to an insulation of the cable and a wire crimp to connect the contact terminal to a wiring of the cable may be utilized for connecting the cable to the contact terminal. The cable may include one or more wires and the insulation may be any insulation known by the skilled person.

Further features and advantages will appear more clearly on a reading of the following detailed description of the preferred embodiments, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
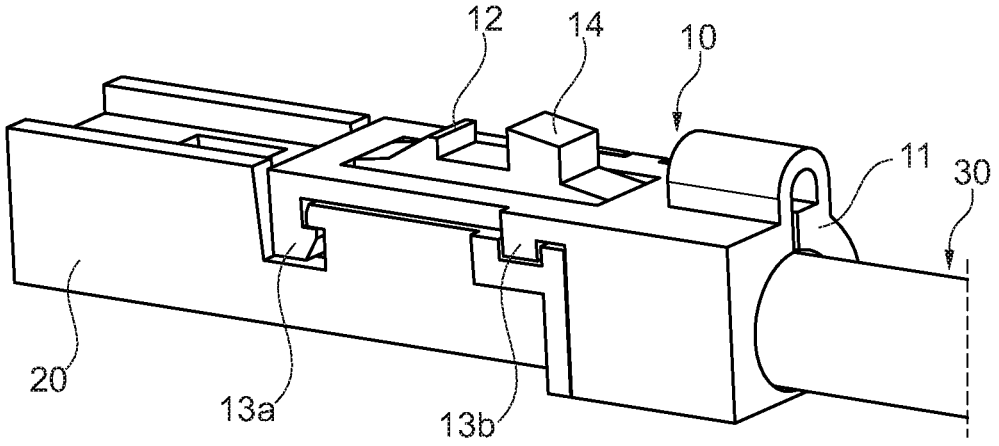
FIG. 1 is a schematic illustration of an electrical connector system in accordance with one embodiment.
Figure 2:
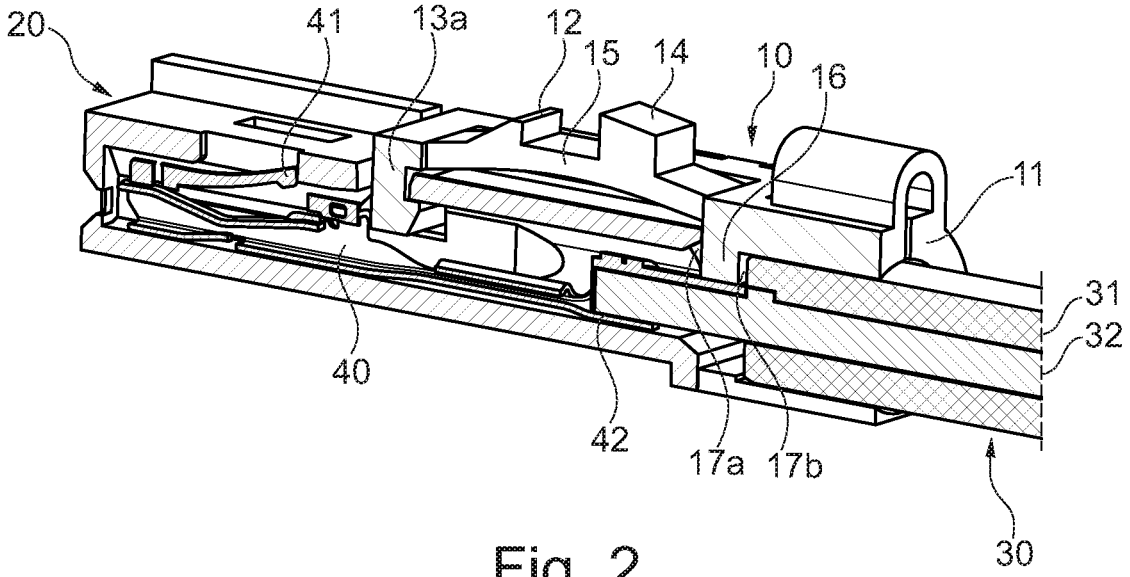
FIG. 2 shows a three-dimensional cross-section of FIG. 1 in accordance with one embodiment.

FIG. 1 shows a perspective view of an electrical connector system in accordance with the invention. In FIG. 2, the electrical connector system of FIG. 1 is shown in a three-dimensional cross-section. As one can see in FIGS. 1 and 2, the illustrated electrical connector system comprises a connector housing 20, which in turn comprises at least one aperture designed to receive a contact terminal 40 therein. The contact terminal 40 may comprise an insulation crimp and a wire crimp for mounting a cable 30 to the contact terminal 40. It will be appreciated that any suitable means may be utilized to mount the cable 30 to the contact terminal 40. An interface 42 between the cable 30 and the contact terminal 40 is denoted as "crimping area" or "crimp area" herein. The contact terminal 40 further comprises a primary locking feature 41, which provides a primary lock for the contact terminal 40 to secure the contact terminal 40 in its position in the aperture of the connector housing 20. The primary locking feature 41 may further comprise a latching lance. While any means may be utilized to provide the primary locking function, the latching lance is preferable because, during assembly of the system, the latching lance latches with the connector housing 20 when the contact terminal 40 is fully inserted into the aperture of the connector housing 20, thereby allowing for an easy assembly.

Figure 5:
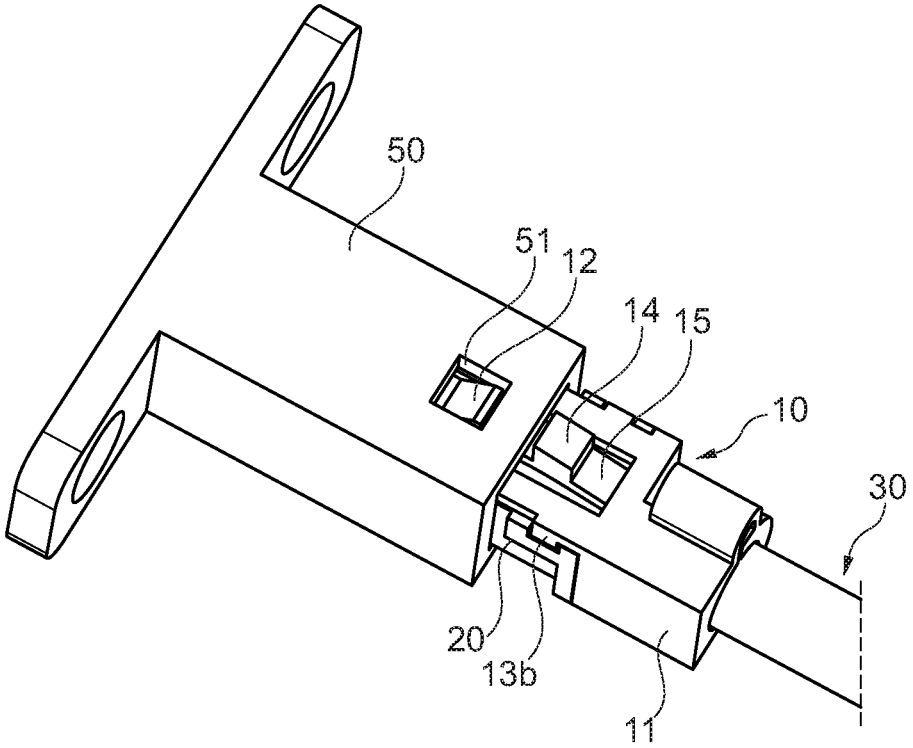
FIG. 5 is a schematic illustration of an electrical connector system in accordance with one embodiment.

The electrical connector system further comprises a cable strain relief member 10 which is a separate component from the connector housing 20. The cable strain relief member 10 comprises an integrated locking feature 12 which locks the cable strain relief member 10 directly to a corresponding counter connector 50 (FIG. 5). As illustrated, the integrated locking feature 12 is preferably a locking ramp. The locking ramp includes an insertion ramp face, or ramp wedge, which faces into the direction of insertion during assembly of the system. The locking ramp further includes a locking ramp face perpendicular to the direction of insertion and faces into the opposed direction of insertion. However, the integrated locking feature 12 may also be of other shapes, such as a block-shape, for example.

The integrated locking feature 12 is supported by a flexible web 15 which in turn includes an actuating member 14. The flexible web 15 is designed to release the integrated locking feature 12 from the corresponding counter connector 50 when an external force is applied to the flexible web 15. Similarly, the flexible web 15 may be designed to allow for an easy insertion of the illustrated electrical connector system into a corresponding counter connector 50 when an external force is applied to the flexible web 15. The cable strain relief member 10 further comprises a fastening feature 11 for fastening the cable strain relief member 10 to the cable 30 for strain relief. It will be appreciated that the fastening feature 11 is only sketched in the figures and that any means for fastening the cable strain relief member 10 to the cable 30 may be utilized. For example, the cable strain relief member 10 may be clamped, squeezed or glued to the cable 30. Alternatively, a snap-lock system may be applied or a metal sleeve may be utilized for coupling the cable 30 to the cable strain relief member 10, for example. The cable 30 in turn comprises a cable sheathing 31 and a wiring 32. It will be appreciated that the wiring 32 may consist of one or more wires and that the present invention is not restricted to any particular sort or kind of cable sheathing 31.

Figure 3:
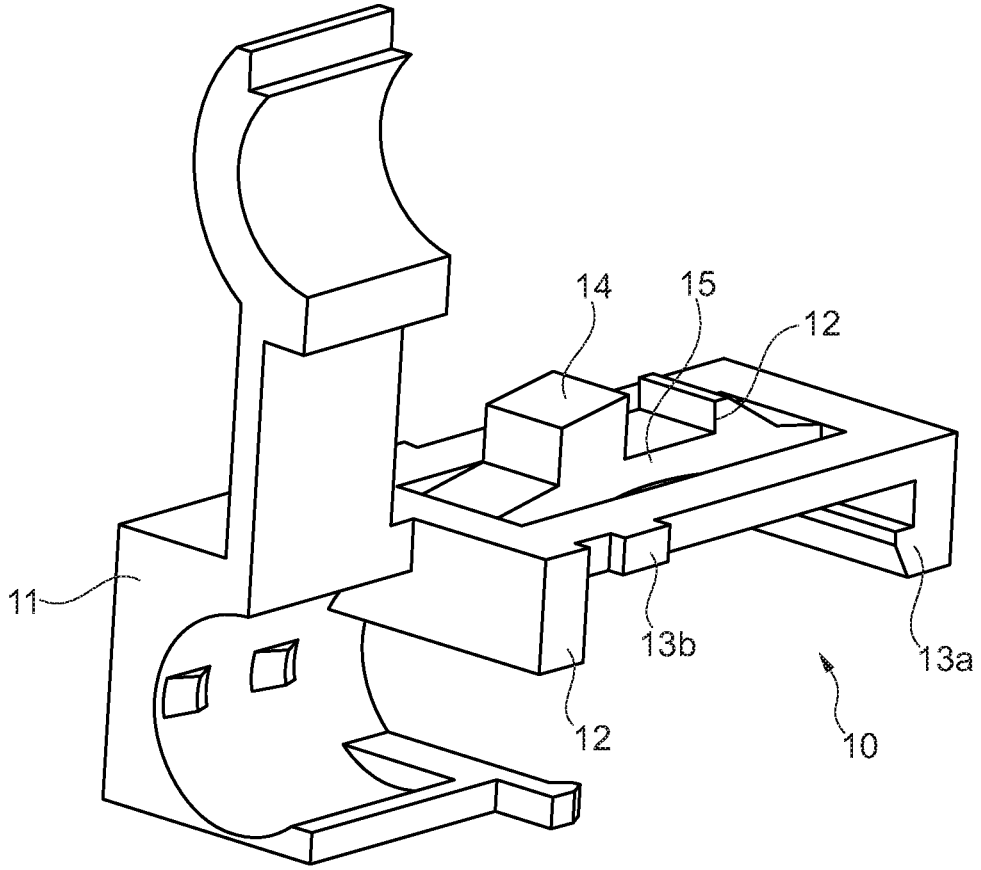
FIG. 3 is a schematic illustration of a cable strain relief member in accordance with one embodiment.
Figure 4:
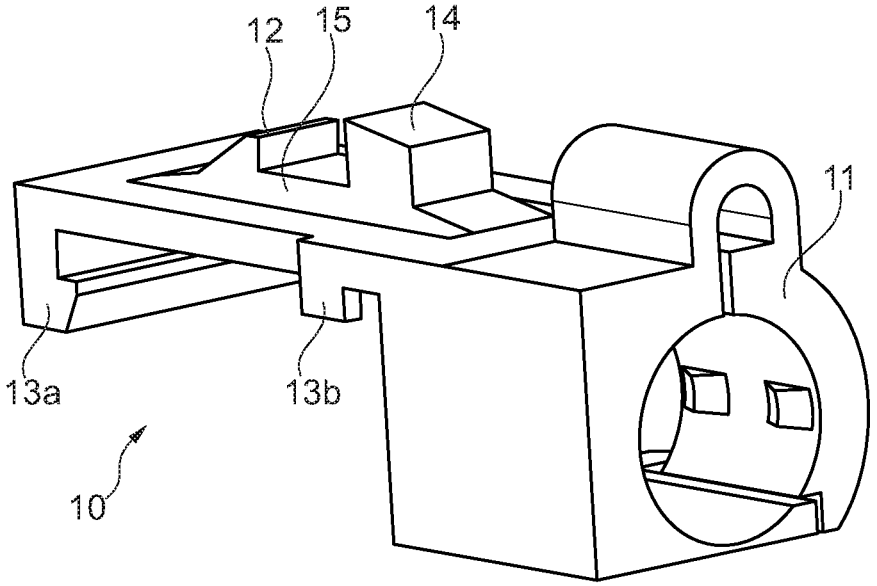
FIG. 4 shows the cable strain relief member of FIG. 3 from a different perspective in accordance with one embodiment.

As can further be seen from FIGS. 3 and 4, the cable strain relief member 10 of FIGS. 1 and 2 also comprises mounting features 13*a* and 13*b* for mounting the cable strain relief member 10 to the connector housing 20. The mounting features 13*a* and 13*b* thereby allow for securing the position of the cable strain relief member 10 to the connector housing 20. The mounting features 13*a* and 13*b* may be designed to fit into corresponding features, such as protrusions, apertures or clearances of the connector housing 20. As illustrated, the mounting features 13*a* and 13*b* may comprise at least one hook designed to envelope a section of the connector housing 20. Preferably, the mounting features 13*a* and 13*b* has a U-shaped cross sectional profile such that the mounting features 13*a* and 13*b* can envelope a section of the connector housing 20. This allows for an easy fixation during the mounting of the cable strain relief member 10 to the connector housing 20 during assembly of the electrical connector system.

As can be seen from FIG. 2, the mounting feature 13*a* also provides terminal position assurance TPA. Accordingly, mounting the cable strain relief member 10 to the connector housing 20 indicates that the pre-inserted contact terminal 40 is in correct position inside the connector housing 20, reducing the need for any costly and expensive inspection during assembly.

The mounting feature 13*a* may further provide a secondary lock for the contact terminal 40. Accordingly, when the primary locking feature 41 of the contact terminal 40 fails, the secondary lock hinders the contact terminal 40 from dropping out of the connector housing 20. As can be seen in FIG. 1, the mounting feature 13*a* includes a portion extending into the connector housing 20 which in turn blocks the aperture of the connector housing 20. Preferably the contact terminal 40 is of such shape that it gets fixed in the blocked aperture of the connector housing 20 and cannot be removed when the cable strain relief member 10 is mounted to the connector housing 20.

Accordingly, the mounting feature 13*a* of the electrical connector system of FIGS. 1 and 2 provide three functions in one single piece, namely fixation of the cable strain relief member 10 to the connector housing 20 and thus a locking of the connector housing 20 to the counter connector 50, a TPA functionality, and a secondary locking function for the contact terminal 40. It will be appreciated that a single portion may comprise all these functions, or that separate portions of the cable strain relief member 10 may provide one or more of these functions separately.

The electrical connector system of FIGS. 1 and 2 is designed to be locked to the corresponding counter connector 50 only by the integrated locking feature 12, because the connector housing 20 shown does not in itself have any primary locking feature 41. However, it will be appreciated that the connector housing 20 may itself include an integrated feature for locking the connector housing 20 to the counter connector 50, as will be recognized by one skilled in the art, in which case the integrated locking feature 12 of the cable strain relief member 10 provides a secondary lock for the connector housing 20.

Figure 6:
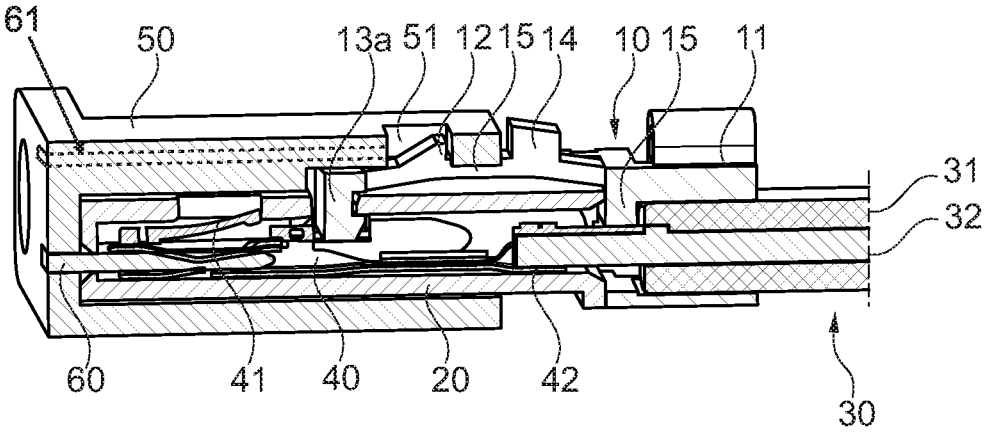
FIG. 6 shows a three-dimensional cross-section of FIG. 5 in accordance with one embodiment.

FIGS. 5 and 6 show another electrical connector system, where the electrical connector system of FIGS. 1 and 2 is connected to a corresponding counter connector 50. The counter connector 50 may have any desired and suitable shape. A contact pin 60 of the counter connector 50 is in electrical contact with the contact terminal 40, which provides electrical contact to the wiring 32 of the cable 30. The counter connector 50 comprises a locking window 51 which is designed to receive the integrated locking feature 12 of the cable strain relief member 10. It will be appreciated that the counter connector 50 may include the locking ramp and the cable strain relief member 10 include the locking window 51 designed to receive the locking ramp of the counter connector 50 instead. As can be seen from FIG. 6 in detail, the cable strain relief member 10 provides strain relief for the crimp area 42 and the primary locking feature 41 of the contact terminal 40. In particular, when a pull-out force is applied to the cable 30, the pull-out force is transferred via the fastening feature 11 and integrated locking feature 12 of the cable strain relief member 10 directly to the corresponding counter connector 50. Hence the crimp area 42 and the primary locking feature 41 of the contact terminal 40 have to withstand less pull-out force.

Further on, the cable strain relief member 10 includes a flexible web 15, which supports the integrated locking feature 12 and includes the actuating member 14. The flexible web 15 is formed to provide a restoring force perpendicular to the direction of insertion or removal of the connector housing 20 with mounted cable strain relief member 10 into or from the corresponding counter connector 50, when a force is applied to the flexible web 15. In general, an operator can insert or remove the connector housing 20 with mounted cable strain relief member 10 into the corresponding counter connector 50 by applying force to the flexible web 15 such that the flexible web 15 bows and the integrated locking feature 12 supported by the flexible web 15 is displaced. Preferably, as illustrated, the integrated locking feature 12 is a locking ramp. Accordingly, once the connector housing 20 with mounted cable strain relief member 10 is inserted into the corresponding counter connector 50, the flexible web 15 bows as a result, such that the integrated locking feature 12 can access the corresponding locking window 51 in the counter connector 50 to provide the locking function. This allows for an easy assembly of the electrical connector system.

By pressing on the actuating member 14, which is preferably located outside the counter connector 50 as illustrated in FIG. 5, an operator can unlock the integrated locking feature 12. By applying a force to the flexible web 15, the integrated locking feature 12 is displaced such that it is no longer in locking contact with the corresponding counter connector 50. This allows for extracting the connector housing 20 with mounted cable strain relief member 10 from the corresponding counter connector 50 simply by applying a force on the flexible web 15 by pressing on the actuating member 14 and by pulling the cable 30. Accordingly, the connector housing 20 with mounted cable strain relief member 10 can then be extracted from counter connector 50 in a non-destructive way. Again, the cable strain relief member 10 reduces the force acting on the crimp area 42, by transferring the pull-out force during the disassembly via the fastening feature 11 and the mounting features 13*a* and 13*b* directly to the connector housing 20. Thereby, the fragile crimping area is protected.

As illustrated in FIG. 2 the cable strain relief member 10 further includes a spacer 16. The spacer 16 is located between the cable sheathing 31 and the connector housing 20 and comprises two surfaces; A first surface 17*a* is in contact with the connector housing 20, while a second surface 17*b* is in contact with the cable sheathing 31. When pushing the cable 30 mounted to the contact terminal 40 provided in the connector housing 20 into the corresponding counter connector 50, the push-in force is transferred via the spacer 16 directly to the connector housing 20. Thereby, the push-in force acting on the crimp area 42 is reduced. Accordingly, the spacer 16 may reduce an overstraining of the crimping area during assembly of the electrical connector system.

Upon inserting the connector housing 20 and the mounted cable strain relief member 10 into the counter connector 50, the integrated locking feature 12 interacts with the counter connector 50 such that the flexible web 15 is lowered. When the connector housing 20 with the mounted cable strain relief member 10 is fully inserted into the corresponding counter connector 50, the locking ramp snaps into locking position, i.e. in the locking window 51 of the counter connector 50, due to the restoring forces of the flexible web 15. The actuating member 14 may be designed to prevent further insertion of the connector housing 20 with mounted cable strain relief member 10 into the counter connector 50, thereby preventing an overstraining of the crimp area 42.

According to one particular aspect of the present invention, the integrated locking feature 12 may be assessed from "inside" the counter connector 50. With reference to FIG. 6, the a channel 61 (indicated by dashed lines) may be provided in the counter connector 50 that runs from the left hand side in the mating direction to the locking window 51. The channel 61 would enable the insertion of a screw driver, or similar tool, from the left side of FIG. 6, to eventually urge the integrated locking feature 12 downwards for releasing the locking function. The ramp-like shape of the integrated locking feature 12 is hence particularly preferred in this respect, as it allows for flexing the flexible web 15 by actuating the integrated locking feature 12 in mating direction of the system. The channel 61 indicated in FIG. 6 is only provided for illustrative purposes and may require a larger dimension to enable the insertion of a tool. This may be achieved by enlarging the respective wall thickness of the counter connector 50 in the portion comprising the channel 61.

Accordingly, an electrical connector system that reduces the strain on the crimping area and also on the primary and/or secondary lock of connector systems is provided. The electrical connector system comprises a minimal number of components and is simple to be mounted and further includes terminal position assurance (TPA).

While this invention has been described in terms of the preferred embodiments thereof, it is not intended to be so limited, but rather only to the extent set forth in the claims that follow.

The invention claimed is:

1. An electrical connector system comprising:

a contact terminal;

a connector housing defining an aperture configured to receive the contact terminal therein; and a cable strain relief member separate from the connector housing, which comprises a cable fastening feature for fastening the strain relief member to a cable for strain relief, and wherein the strain relief member further comprises an integrated locking feature that locks the strain relief member directly to a corresponding counter connector, wherein the strain relief member further comprises a mounting feature for mounting the strain relief member to the connector housing, wherein the mounting feature comprises a hook that envelopes a section of the connector housing when the strain relief member is mounted thereto, wherein the hook has a U-shaped cross sectional profile.

2. The connector system of claim 1, wherein the mounting feature provides a terminal position assurance (TPA) when the contact terminal is provided in the aperture of the connector housing and the strain relief member is mounted to the connector housing.

3. The connector system of claim 2, wherein the mounting feature provides a secondary lock for the contact terminal to secure the contact terminal in the aperture of the connector housing.

4. The connector system of claim 3, wherein the mounting feature includes a portion extending into the connector housing when the strain relief member is mounted thereto, wherein the portion is configured to prevent removal of the contact terminal from its position in the aperture of the connector housing.

5. The connector system of claim 4, wherein the strain relief member is configured to releasable lock the connector housing to the corresponding counter connector.

6. The connector system of claim 5, wherein the strain relief member further comprises an integrated flexible web supporting the integrated locking feature, wherein the flexible web is configured to release the integrated locking feature from the corresponding counter connector when an external force is applied to the flexible web.

7. The connector system of claim 6, wherein the integrated flexible web includes an actuating member.

8. The connector system of claim 7, wherein the actuating member is located outside the counter connector when the strain relief member is locked to the counter connector.

9. The connector system of claim 8, wherein the actuating member of the strain relief member is configured to be actuated by a tool for unlocking the strain relief member from the counter connector.

10. The connector system of claim 9, wherein the integrated locking feature is a locking ramp.

11. The connector system of claim 10, wherein the integrated locking feature of the strain relief member is configured to be actuated by a tool for unlocking the strain relief member from the counter connector.

12. The connector system of claim 11, wherein the strain relief member is configured to be unlocked from the counter connector when an external force is applied in mating direction of the connector system to the integrated locking feature of the strain relief member.

13. The connector system of claim 12, wherein the connector housing comprises an integrated locking feature that locks the connector housing to the corresponding counter connector providing a primary lock for the connector housing.

14. The connector system of claim 13, wherein the contact terminal comprises a primary locking feature that locks the contact terminal in the aperture of the connector housing, wherein the primary locking feature is a latching lance.

15. The connector system of claim 14, wherein the connector housing comprises a rib configured to interact with the counter connector for preventing a further insertion of the connector housing into the counter connector when the strain relief member is locked to the counter connector.

16. The connector system of claim 14, wherein the strain relief member further comprises a spacer that separates the cable from the connector housing when the system is fully mounted.

17. The connector system of claim 16, wherein the spacer comprises two surfaces, wherein a first surface is in contact with the connector housing and a second surface is in contact with a cable sheathing of the cable.

18. The connector system of claim 17, wherein the system further comprises a corresponding counter connector, said counter connector defining an aperture that receives the connector housing and strain relief member therein.

19. The connector system of claim 18, wherein the counter connector comprises a channel enabling an application of an external force in a mating direction of the connector system to the strain relief member and in particular to the integrated locking feature of the strain relief member for unlocking the strain relief member from the counter connector.

20. The connector system of claim 19, wherein the channel of the counter connector is provided in the mating direction of the connector system.

21. The connector system of claim 20, wherein the aperture of the counter connector is step-like shaped, wherein a first step of the step-like shaped aperture interacts with a rib of the connector housing for preventing a further insertion of the connector housing into the counter connector when the strain relief member is locked to the counter connector.

22. The connector system of claim 17, wherein the system further comprises a cable mounted to the contact terminal.

* * * * *